US005165460A

United States Patent [19]

Guthrie

[11] Patent Number: 5,165,460

[45] Date of Patent: Nov. 24, 1992

[54] VERTICAL VENETIAN BLINDS

[76] Inventor: Mark F. Guthrie, 1781 Stanton Ave., Largo, Fla. 34640

[21] Appl. No.: 831,819

[22] Filed: Feb. 6, 1992

[51] Int. Cl.[5] ..... E06B 9/30

[52] U.S. Cl. ..... 160/176.1; 160/236; 160/900

[58] Field of Search ..... 160/236, 900, 168.1, 160/176.1, 173, 178.1, 172, 166.1, 167, 169, 170, 171, 174, 175, 177, 34, 107

[56] References Cited

U.S. PATENT DOCUMENTS

| | | | |
|---|---|---|---|
| 2,325,992 | 8/1943 | Wirthman | 160/230 X |
| 3,742,648 | 7/1973 | Streeter | 160/900 X |
| 4,445,958 | 5/1984 | Jaksha | 160/230 X |
| 4,574,861 | 3/1986 | Mao | 160/232 X |
| 4,913,216 | 4/1990 | Lemay | 160/166.1 X |

FOREIGN PATENT DOCUMENTS

| | | | |
|---|---|---|---|
| 3104048 | 8/1982 | Fed. Rep. of Germany | 160/236 |

*Primary Examiner*—David M. Purol

*Attorney, Agent, or Firm*—Walter J. Monacelli

[57] ABSTRACT

The vertical Venetian blinds described herein comprise a series of louvers each of which comprises a series of strips, preferably of wood which are arranged parallel to and spaced from each other and adhered to a flexible sheet of backing material, such as cloth with the strips arranged horizontally when the louvers are held in a vertical position. Each of the louvers is held by the upper edge of the backing material and is affixed to a swivel, supporting arrangement capable of rotating the louver approximately 90° on its linear axis from a "closed" position in which one vertical edge of a louver overlaps by a small dimension a vertical edge of an adjacent louver to an "open position" in which the respective backing sheets of the louvers are arranged in positions substantially parallel to each other.

16 Claims, 2 Drawing Sheets

VERTICAL VENETIAN BLINDS

BACKGROUND OF THE INVENTION

1. Field of the Invention

This invention relates to vertical venetian blinds in which each of the vertical louvers comprises a series of strips, preferably of wood, arranged horizontally and parallel to each other and adhered to a sheet of flexible material. More specifically, it relates to a series of such louvers arranged vertically and swivelly supported at the top a supporting means arranged to rotate each of the louvers approximately 90° around the linear axis of the louver. Still more specifically, each of the louvers is capable of being rotated approximately 90° from a "closed" which each of the louvers, except an end louver, overlaps by a small dimension the linear edge of an adjacent louver. Still more specifically, each of the louvers when rotated approximately from the "closed" position will be turned to an "open" position in which the respective louvers are arranged parallel to each other.

2. State of the Prior Art

Vertical Venetian presently used have disadvantage that the individual louvers which are long and narrow have a tendency to warp and become distorted from their original shape.

There are a number of patents describing vertical Venetian typical of which are U.S. Pat. Nos. 4,773,958 and 4,842,036 which show vertical louvers made of laminates and U.S. Pat. No. 5,050,662 which shows a louver system comprising a number of slots curvi-linear in cross-section and multi-layer over at least a part of their length to form a laminate. None of these show the type of vertical louvers of the present invention.

U S. Pat. Nos. 4,445,958 and 4,574,861 show thermal shades in relatively stiff strips are cemented to a flexible fabric so that the composite may be rolled up. However the respective extend across the full-width of the composite and do not comprise a vertical type of venetian blind. In fact the composite resembles more a roll-up type of shape.

None of the above patents show the vertical Venetian of the present invention in which the individual vertical louvers comprise a series of relatively short which extend only across the width of the individual louvers.

OBJECTIVES

It is an object of this invention to provide a louver suitable for use in a vertical venetian blind which can avoid warping.

It is also an object of this invention to provide a vertical Venetian blind having slats comprising a series of parallel strips spaced from each other. Arranged horizontally and cemented or otherwise adhered to a flexible backing material.

It is also an object of this invention to provide a Venetian blind in which the vertical slats are supported at the top end of the slats by a swivel supporting means which can rotate the individual slats approximately 90° about its linear axis.

Other objects will become obvious upon reading the detailed description of the invention as given hereinafter.

SUMMARY OF THE INVENTION

In accordance with the present invention, these objectives are met the device of this invention which comprises new vertical venetian These new vertical Venetian blinds comprise a series of vertical louvers, each of which louvers comprises a series of strips, preferably of wood. which are arranged horizontally to and spaced from each other, and adhered to a flexible sheet of backing material, such as cloth. Each of the louvers is held by the upper edge of the backing material and is affixed to a swivel, supporting means capable of rotating the louver approximately 90° on its linear axis from a "closed" position in which one vertical edge of a louver overlaps by a dimension a vertical edge of an adjacent louver, to an "open" position in which the respective backing sheets of the louvers are arranged in positions substantially parallel to each other.

The strips are made of a rigid material, such as wood, to prevent warpage of the louvers. In contrast the backing sheet material, such as cloth, is flexible so that individual louvers are capable of being rolled up, for example, for storage. Advantageously the strips are 2–5 inches long, preferably 3–4 inches, and the length of the strips correspond approximately to the width of the backing material.

As indicated above, the supporting means is capable of rotating the individual louvers approximately 90° from a "closed" overapping position to an "open", parallel position, and vice versa back to the "closed" position. In this respect the blinds of this invention are similar to present vertical Venetian blinds, and similar supporting and swivelling means may be used.

PREFERRED SPECIFIC EMBODIMENT

The description of the apparatus of this invention is facilitated by reference to the accompanying drawings.

Figure 1:
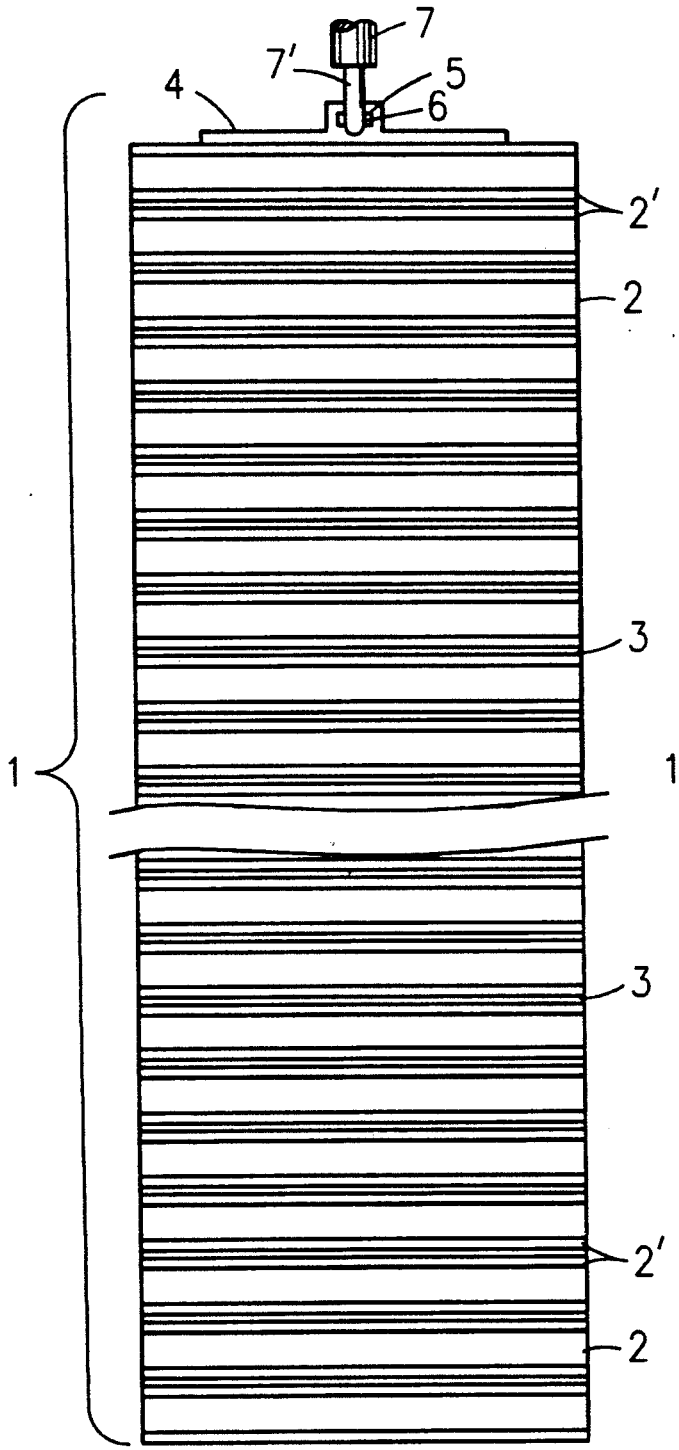
FIG. 1 is a front elevational view of a preferred modification of a louver vertical blind of this invention.

As shown in these drawings louver comprises a series of slats or strips 2, preferably of wood but may be made of plastic and other suitable materials, which are adhered or otherwise horizontally fixed to backing 3, which may be made of cloth, plastic or other sheet material. The edges 2' of strips 2 are advantageously beveled to accommodate folding of strips 2 upon each other. The louver is supported by supporting means 4 which is adhered or to the top of the louver Supporting means 4 has an opening 5 into which hooking means 6 is inserted to support the louver. The sections 8 of supporting means 4 is folded over and adhered to the back side of backing sheet 3. Supporting means 4 is connected to swivel support 7 which has lower stem 7' and can be turned or rotated 90° on its vertical axis from the "closed" position shown in FIG. 3 to the "open" position shown in FIG. 4. The mechanism for turning the louvers is not shown but comprises the standard turning mechanism used in standard vertical blinds which are operated pulling an endless cord at the side of the assembled vertical blind.

Figure 3:
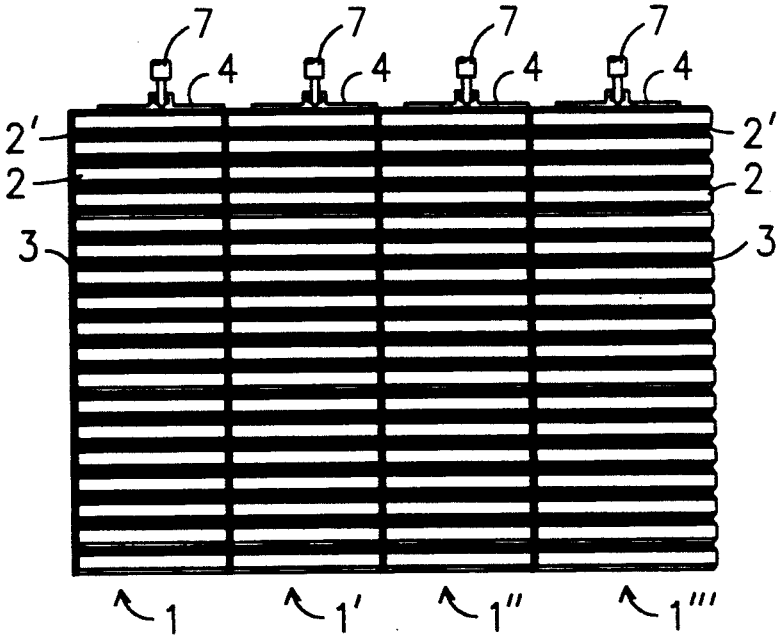
FIG. 3 is a front elevational view of a preferred modification of the assembled vertical blind of this invention showing a number of overlapping louvers of FIG. 1 in "closed" position.

FIG. 3 shows four louvers 1, 1', 1'' and 1''' in closed position with the edge of louver 1''' overlapping louver 1'', the edge of louver 1'' overlapping louver 1' and the edge of louver 1' overlapping louver 1. Preferably the overlapping is about ⅜ of an inch. Sections 8 of supporting means 4 are bent over and adhered to the top of backing sheet 3. Hooking means 6' extending upward from supporting 4 has an opening (not shown in this view) and fits into opening 9 of swivel support 7 past flap 10 and engages over hook 11 and is supported thereby. Supporting means 4 is affixed to backing 3 and uppermost strip 2 by means of screw 12. This modification has strips on the back side of backing 3 as well as on the front to give a more decorative appearance to that side of the louver, which side will be seen through a window in front of which the louver may be positioned.

In some modifications it may be desirable to have the rigid strips reach only to just short of the width of the backing material so that when one louver overlaps an adjacent louver the overlapping will occur on the edges of the cloth which do not have the rigid strips extend to the edge of the backing material. This will give a closer fit of louver edge over adjacent louver edge.

Figure 2:
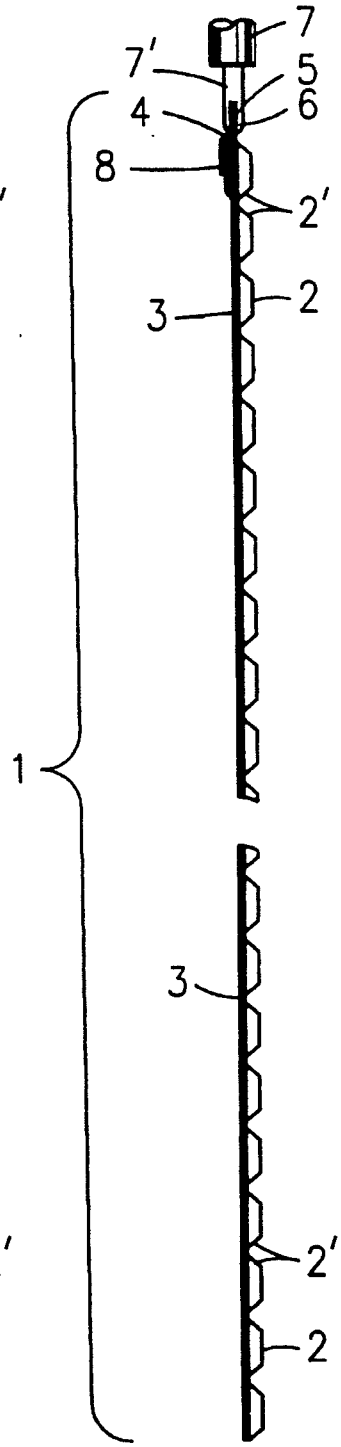
FIG. 2 is a side elevational view of the modification of FIG. 1.
Figure 4:
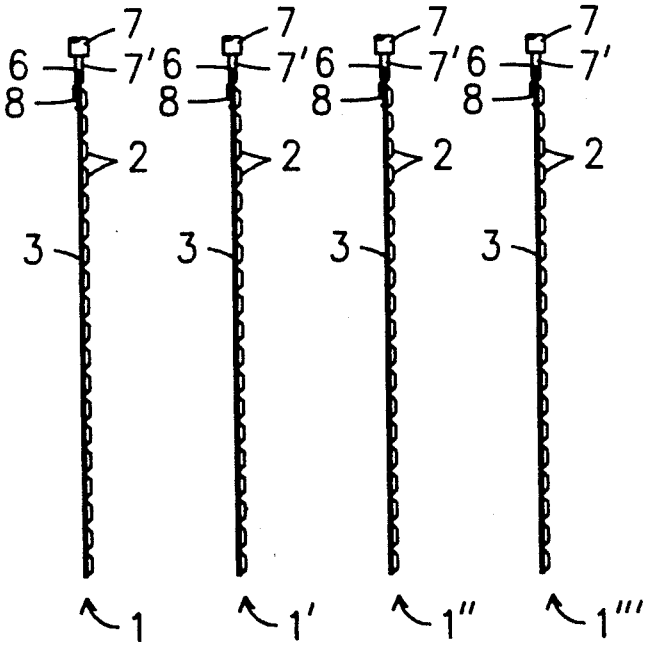
FIG. 4 is a front elevational of the assembled vertical blind FIG. 3 in an "open" position.
Figure 5:
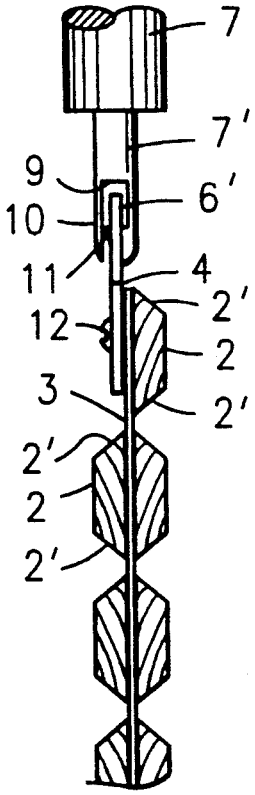
FIG. 5 is an enlarged side elevational partial view of another preferred modification of the blind of this invention showing details of the support and turning mechanism for the vertical louvers.

The cross-section of the rigid strips may be of various shapes in addition to those shown in FIGS. 2, 4, and 5 which show half of a hexagonal shape or rectangular shape in which the outer edges have been tapered. Instead these cross sections, which are perpendicular to the length of the strip, may be semi-circular, semi-oblong, triangular, etc.

The length of the blinds is variable depending on the size of the window to be covered. Moreover the lower end of the individual blinds advantageously has a retaining means for securing that end of the blind from moving out of position except to permit rotation of the blind about its linear axis. This retaining means may be similar to that presently used on vertical venetian blinds.

While certain features of this invention have been described in detail with respect to various embodiments thereof, it will of course be apparent that other modifications can be made within the spirit and scope of this invention, and it is not intended to limit the invention to the exact details shown above except insofar as they are defined in the following claims.

The invention claimed is:

1. Vertical venetian blinds having a top comprising:

(a) a supporting means positioned at the top of said blinds, said supporting means capable of changing the position of an article suspended therefrom through an angle of approximately 90°;

(b) a series of individual louvers, each individual louver being adapted to be suspended in a vertical position hanging down from said supporting means, and capable of being rotated approximately 90° about its linear axis by said rotation of said supporting means;

(c) each individual louver comprising a long, narrow strip of backing material having a length corresponding approximately to the desired length of each individual louver and a width corresponding to the desired width of said individual louver; and a series of rigid strips each having a length corresponding approximately to the width of said backing material and positioned parallel to and spaced from each other, said strips being in horizontal positions when said louver is held in vertical position; and (d) a rotating means capable of rotating at least a portion of each &aid supporting means and each said louver in first one direction and then in reverse direction through approximately 90°, said rotation being such that said louver is rotated accordingly about its linear axis.

2. The vertical venetian blinds of claim 1 in which said individual louvers are positioned so that in a "closed" position one linear edge of an individual louver is in approximate contact with a linear edge of an adjacent individual louver and when said louvers are rotated approximately 90°, the individual louvers are repositioned to an "open" position in which the individuai louvers are substantially parallel to each other.

3. The vertical venetian blinds of claim 2 in which in said "closed" position the edge of each louver overlaps by a small dimension an edge to an adjacent louver.

4. The vertical venetian blinds of claim 1 in which said rigid strips are wood.

5. The vertical venetian blinds of claim 3 in which said rigid strips are wood.

6. The vertical venetian blinds of claim 3 in which said rigid strips are made of plastic.

7. The vertical venetian blinds of claim 1 in which said backing material is cloth.

8. The vertical venetian blinds of claim 3 in which said backing material is cloth.

9. The vertical venetian blinds of claim 5 in which said backing material is cloth.

10. The vertical venetian blinds of claim 1 in which said backing material has a width in the range of 2 to 5 inches.

11. The vertical venetian blinds of claim 3 in which said backing material has a width in the range of 2 to 5 inches.

12. The vertical venetian blinds of claim 5 in which said backing material has a width in the range of 2 to 5 inches.

13. The vertical venetian blinds of claim 7 in which said backing material has a width in the range of 2 to 5 inches.

14. The vertical venetian blinds of claim 3 in which said backing material has a width of approximately 3 to 4 inches.

15. The vertical venetian blinds of claim 5 in which said backing material has a of approximately 3 to 4 inches.

16. The vertical venetian blinds of claim 7 in which said backing material has a width of approximately 3 to 4 inches.

* * * * *

UNITED STATES PATENT AND TRADEMARK OFFICE

CERTIFICATE OF CORRECTION

PATENT NO. : 5,165,460

DATED : November 24, 1992

INVENTOR(S) : Mark F. Guthrie

It is certified that error appears in the above-identified patent and that said Letters Patent is hereby corrected as shown below:

Col. 1, line 16, after "closed" insert "position in".

Col. 1, line 24, after "Venetian" insert "blinds".

Col. 1, line 39, after "respective" insert "strips".

Col. 1, line 43, after "Venetian" insert "blind".

Col. 1, line 45, after "short" insert "strips".

Col. 1, line 54, rewrite "other. Arranged" to read "other, arranged".

Col. 1, line 68, after "met" insert "by".

Col. 2, line 1, change "venetian" to read "Venetian blinds".

Col. 2, line 26, correct "overapping" to read "overlapping".

Col. 2, line 49, after "louver" insert "l".

UNITED STATES PATENT AND TRADEMARK OFFICE

CERTIFICATE OF CORRECTION

PATENT NO. : 5,165,460
DATED : November 24, 1992
INVENTOR(S) : Mark F. Guthrie

It is certified that error appears in the above-indentified patent and that said Letters Patent is hereby corrected as shown below:

Col. 4, line 10, correct "&aid" to read "said".

Signed and Sealed this

Twelfth Day of October, 1993

*Attest:*

*Attesting Officer*

Bruce Lehman

BRUCE LEHMAN

*Commissioner of Patents and Trademarks*